US005525127A

United States Patent [19]

Jeffrey

[11] Patent Number: 5,525,127

[45] Date of Patent: Jun. 11, 1996

[54] EVAPORATIVE BURNER FUELS AND ADDITIVES THEREFOR

[75] Inventor: Gareth C. Jeffrey, Bracknell, United Kingdom

[73] Assignee: Ethyl Petroleum Additives Limited, Bracknell, England

[21] Appl. No.: 347,768

[22] Filed: Nov. 30, 1994

[51] Int. Cl.[6] ..... C10L 1/14; C10L 1/18

[52] U.S. Cl. ..... 44/359; 44/347; 44/404

[58] Field of Search ..... 44/359, 404

[56] References Cited

U.S. PATENT DOCUMENTS

| | | | |
|---|---|---|---|
| 3,190,733 | 6/1965 | Riggs, Jr. | 44/404 |
| 3,346,355 | 10/1967 | Ecker | 44/404 |
| 3,533,765 | 10/1970 | Kerley et al. | 44/359 |
| 3,558,292 | 1/1971 | Abowd, Jr. | 44/359 |
| 4,140,491 | 2/1979 | Allain et al. | 44/56 |
| 4,141,693 | 2/1979 | Feldman et al. | 44/68 |
| 4,175,927 | 11/1979 | Niebylski | 44/68 |
| 4,197,091 | 4/1980 | Gainer | 44/404 |
| 4,317,657 | 2/1982 | Niebylski | 44/66 |
| 4,509,951 | 4/1985 | Knapp | 44/404 |
| 5,393,309 | 2/1995 | Cherpeck | 44/347 |

FOREIGN PATENT DOCUMENTS

| | | |
|---|---|---|
| 476196 | 3/1992 | European Pat. Off. . |
| 476197 | 3/1992 | European Pat. Off. . |

*Primary Examiner*—Ellen M. McAvoy
*Attorney, Agent, or Firm*—Dennis H. Rainear

[57] ABSTRACT

Hydrocarbonaceous distillate fuel compositions and additive concentrates are described that provide improved performance in evaporative burners. The additive components comprise a mixture formed from at least (a) a cyclopentadienyl manganese tricarbonyl compound; (b) a succinic derivative ashless dispersant; (c) an aliphatic dicarboxylic acid having at least 24 carbon atoms in the molecule, the two carboxyl groups being separated from each other by at least 6 carbon atoms; and (d) a metal deactivator of the chelation type. Preferably, the compositions also contain (e) alkoxylated alkylphenol; (f) a demulsifying agent; (g) a tertiary monoamine in which each substituent on the nitrogen atom is a hydrocarbyl group; and (h) liquid inert solvent having a final boiling point no higher than approximately 300° C. The compositions are devoid of any metal-containing additive component other than the cyclopentadienyl manganese tricarbonyl compound.

35 Claims, No Drawings

EVAPORATIVE BURNER FUELS AND ADDITIVES THEREFOR

Evaporative burners are of two general types—wick-type burners and pot-type burners. Both types depend for effective operation on clean evaporation of the fuel accompanied by as little metal corrosion as possible. Moreover, environmental concerns and considerations impose the additional need for fuels that burn cleanly and that produce on combustion reduced amounts of smoke and noxious emissions.

Certain organomanganese compounds, notably methylcyclopentadienyl manganese tricarbonyl (MCMT) and its volatile analogs and homologs, have long been known to be efficient combustion improvers for burner fuels. More recently, MCMT formulations which are highly effective in improving combustion of middle distillate fuels have been described—see in this connection EP476,196 and 476 197. These formulations utilize additive combinations which include, in addition to the cyclopentadienyl manganese tricarbonyls, a metal-containing detergent and a dispersant. These formulations perform very effectively under most types of service conditions. However in evaporative burner service there is a tendency for the fuel treated with such formulations to leave residues in the apparatus. These residues have been traced to the presence in the formulations of the metal-containing detergent component, and thus it has been suggested heretofore to eliminate the metal-containing detergent component from the formulations. However to do so gives rise to a new set of difficulties, viz., the need to inhibit the increased metal corrosion that results when the increased basicity provided by the detergent component has been lost because of elimination of the detergent component from the formulation.

There is, therefore, a need for a new additive system which can be effectively used in fuels for use in evaporative burners, fuels that during operation under actual service conditions, evaporate cleanly, produce little or no residues in the apparatus, cause little or no metallic corrosion in the apparatus, burn cleanly, and produce on combustion reduced amounts of smoke and noxious emissions.

This invention is deemed to fulfill the foregoing combination of needs in a highly efficient manner.

In accordance with one embodiment of this invention, there is provided an additive composition adapted for use in hydrocarbonaceous distillate fuels for evaporative burners, said composition comprising a mixture formed from at least the following components each of which must be fuel-soluble:

a) a cyclopentadienyl manganese tricarbonyl compound, which preferably (but not necessarily) is a liquid under ambient room temperature conditions, and which most preferably is composed primarily or entirely of MCMT;

b) a succinic derivative ashless dispersant, preferably a succinimide ashless dispersant;

c) an aliphatic dicarboxylic acid having at least 24 carbon atoms in the molecule, and preferably at least 30 carbon atoms in the molecule, the two carboxyl groups being separated from each other by at least 6 carbon atoms; and d) a metal deactivator of the chelation type, preferably N,N'-disalicylidene-1,2-propanediamine; said composition being substantially devoid of any metal-containing additive component other than said cyclopentadienyl manganese tricarbonyl compound. It is interesting to note that despite the absence of any basic metal detergent, the benefits of this invention are achieved in part through the inclusion in the additive mixture of an acidic component, viz., component c).

In accordance with preferred embodiments of this invention, the foregoing additive composition further comprises one or more, and most preferably all, of the following additional components blended therewith:

e) alkoxylated alkylphenol, preferably an ethoxylated alkylphenol having 6 to 24 carbon atoms or an average in the range of 6 to 24 carbon atoms in the alkyl group;

f) a demulsifying agent;

g) a tertiary monoamine in which each substituent on the nitrogen atom is a hydrocarbyl group, and which preferably is a (cycloalkyl)dialkylamine;

h) liquid inert solvent having a final boiling point no higher than approximately 300° C.

Still other fuel additive components may be included in the foregoing additive compositions with the provisos that they are non-metallic additives and that they do not have a material adverse effect on the performance of the composition to which they are added.

Another embodiment is a hydrocarbonaceous distillate fuel suitable for use in an evaporative burner containing a minor combustion improving amount of a fuel additive composition of this invention.

Still another embodiment is the method of improving combustion and fuel performance in the operation of an evaporative burner which comprises supplying as fuel for said burner a hydrocarbonaceous distillate fuel composition of this invention.

The use of a fuel additive composition of this invention to improve the combustion and fuel performance of a hydrocarbonaceous distillate fuel composition in and for an evaporative burner constitutes a further embodiment of this invention.

These and other embodiments will be still further apparent from the ensuing description and appended claims.

Base Fuels. The hydrocarbonaceous distillate fuels which can be utilized in the practice of this invention are liquid fuels suitable for use as fuels for evaporative burners. These fuels are illustrated by, but are by no means limited to, such fuels as kerosines (for example fuels in accordance with ASTM D 3699-92); Number 1 and Number 2 distillate fuels (for example fuels in accordance with ASTM D 396); distillate fuels complying for example with the U.K. BS 2869 specifications; light or extra light fuel oils complying for example with the DIN 51 603, Part 1 specifications of 1988.

Component a). Illustrative cyclopentadienyl manganese tricarbonyl compounds suitable for use in the practice of this invention include such compounds as cyclopentadienyl manganese tricarbonyl, methylcyclopentadienylmanganesetricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienylmanganesetricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, e.g., U.S. Pat. No. 2,818,417.

Component b). A succinic acylating agent is used in forming the succinic derivatives employed as component b). The succinic acylating agent has a long chain alkyl or alkenyl substituent having an average in the range of 30 to 250 carbon atoms, preferably an average in the range of 50 to 150 carbon atoms, and most preferably an average in the range of 60 to 90 carbon atoms. While homopolymers and copolymers of a variety of 1-olefins can be used for preparing the long chain substituent of the acylating agent, commercial grades of polyisobutene are the preferred materials. Although the acylating agent can be a long chain succinic acid, a long chain succinic acid halide, or a long chain succinic ester or half ester of an alcohol having up to 7 carbon atoms, the acylating agent is preferably a long chain succinic anhydride.

The ashless dispersant is formed by reacting the succinic acylating agent with a polyol having an average in the range of 2 to 5 hydroxyl groups per molecule and/or a polyamine having an average in the range of 2 to 6 nitrogen atoms per molecule. Thus the succinic derivative ashless dispersant is a succinic ester, a succinic ester-amide or preferably a succinimide. Long chain succinimides of a polyamine 3 to 5 nitrogen atoms per molecule is especially preferred.

Methods for producing suitable aliphatic hydrocarbylsuccinic acylating agents (acid, anhydride, lower alkyl ester, or acyl halide), and suitable succinic derivative ashless dispersants (substituted succinic esters, substituted succinic ester-amides, or substituted succinimides) can be found in the literature. Reference may be had, for example, to U.S. Pat. Nos. 3,215,707; 3,219,666; 3,231,587; 3,254,025; 3,282,955; 3,361,673; 3,401,118; 3,912,764; 4,110,349; 4,234,435; 4,908,145; 5,071,919; 5,080,815; and 5,137,978. In general the succinic acylating agent and the polyol and/or polyamine are reacted, preferably under an inert atmosphere, at a temperature in the range of about 80° to about 200° C., and preferably in the range of 140° to 200° C., with temperatures in the range 160° to 170° C. being most preferred. The reaction can be conducted in the presence or absence of a solvent or reaction diluent, a diluent or solvent preferably being used when the reaction mixture is sufficiently viscous as to render it difficult to stir or agitate the reaction mixture. The succinic ester ashless dispersants used in the practice of this invention preferably are formed using from 0.5 to 1.1 moles of polyol per mole of succinic acylating agent. When forming the succinimides, from 0.4 to 0.9 moles of polyamine and preferably from 0.5 to 0.7 moles of polyamine are used per mole of the succinic acylating agent. Succinic ester-amides can be formed using a combination of polyol and polyamine or a hydroxy-substituted amine in proportions sufficient to convert the acylating agent into the desired ashless dispersant.

Preferred polyamines for use in preparing the succinimides and succinic ester-amides are alkylene polyamines, especially ethylene polyamines, having an average of from 2 to 6 and preferably 3 to 5 nitrogen atoms in the molecule. Such materials are often referred to as alkylene diamines, dialkylene triamines, trialkylene tetramines, tetraalkylene pentamines and pentaalkylene hexamines. Such materials can be used in substantially pure form, as for example tetraethylene pentamine of the formula:

$$H_2N—C_2H_4—NH—C_2H_4—NH—C_2H_4—NH—C_2H_4—NH_2$$

On the other hand technical grades of these products are available as articles of commerce and can be used advantageously in the preparation of the succinimides and succinic ester-amides. These technical grades typically contain linear, branched and cyclic species. Thus, although commercial technical grade materials may be referred to as, for example, tetraethylene pentamine, they actually are typically composed of linear, branched and cyclic polyethylene polyamine components having an average overall composition approximating that of pure tetraethylene pentamine.

Component c). The aliphatic dicarboxylic acids having at least 24 and preferably at least 30 carbon atoms in the molecule used in the practice of this invention are fuel-soluble compounds in which the two carboxyl groups are separated from each other by at least 6 carbon atoms. These compounds can be derived from suitable natural sources or they can be formed by suitable synthesis procedures known in the art. One particularly useful synthesis procedure involves dimerizing olefinically unsaturated monocarboxylic acids. Thus use can be made of dimerized acids formed from any alkenoic acid or mixture of alkenoic acids that yields a dimer acid having 24 or more carbon atoms in the molecule, or a mixture of dimer acids having an average of 24 or more carbon atoms per molecule more, carbon atoms per molecule. One highly preferred aliphatic dicarboxylic acid is the so-called dimer acid typically having about 36 carbon atoms per molecule formed by dimerization of linoleic acid, which itself can be either a highly purified grade or a technical grade of linoleic acid.

Component d). Metal deactivators of the chelator type are substances which have the capability of reacting or complexing with dissolved metal and/or metal ions. Examples of suitable chelator type of metal deactivators include 8-hydroxyquinoline, ethylene diamine tetracarboxylic acid, β-diketones such as acetylacetone, β-ketoesters such as octyl acetoacetate, and the like. The preferred metal deactivators for use in the practice of this invention, generally regarded as chelators, are Schiff bases, such as N,N'-disalicylidene-1,2-ethanediamine, N,N'-disalicylidene-1,2-propanediamine, N,N'-disalicylidene-1,3-propanediamine, N,N'-disalicylidene-1,2-cyclohexanediamine, N,N''-disalicylidene-N'-methyl-dipropylenetriamine, 3'-ethoxy-5,2',6'-trimethyl-N,N'-disalicylidenebiphenyl-2,4'-diyldiamine, 5'-ethoxy-3,5,2'-trimethyl-N,N'-disalicylidene-biphenyl-2,4'-diyldiamine, and analogous compounds in which one or more of the salicylidene groups are substituted by innocuous groups such as alkyl, alkoxy, alkylthio, alkenyl, cycloalkyl, cycloalkenyl, aryl, alkoxyalkyl, aralkyl, carboxyl, esterified carboxyl, etc. The most preferred metal deactivators of this type are N,N'-disalicylidene-1,2-alkanediamines and N,N'-disalicylidene-1,2-cycloalkanediamines, especially N,N'-disalicylidene-1,2-propanediamine. Mixtures of metal deactivators can be used.

Component e). Various fuel-soluble alkoxylated alkylphenols can be used in the practice of this invention. Such phenols typically are substituted by at least one alkyl group having six or more carbon atoms, although phenols in which the ring is substituted by two or more shorter chain alkyl groups can be utilized in forming the alkoxylated phenols used as component e). The chief requirement is that the alkyl substitution be such as to render the final product fuel soluble.

Alkylene oxides used in forming the alkoxylated alkylphenols are typically 1,2-epoxides, such as ethylene oxide, propylene oxide, 1,2-butylene oxide, and higher analogs and homologs. The extent of the alkoxylation can be varied such that the resultant alkoxylated alkylphenol contains in the range of 2 to 6 or more alkoxy groups per molecule.

The preferred alkoxylated phenols are the ethoxylated alkylphenols having 6 to 24 carbon atoms or an average in the range of 6 to 24 carbon atoms in the alkyl group and an average of about 3 to 5, preferably 4, ethyleneoxy groups per molecule.

Component f). A variety of suitable demulsifiers are available for use in the practice of this invention, including, for example, polyoxyalkylene glycols, oxyalkylated phenolic resins, and like materials. Also useful are mixtures of polyoxyalkylene glycols and oxyalkylated alkylphenolic resins, such as are available commercially from Petrolite Corporation under the TOLAD trademark. Another useful proprietary product is identified as Armogard D5021, and is available from Akzo Chemical.

Component g). This component is composed of one or more fuel-soluble tertiary monoamines in which each substituent on the nitrogen atom is a hydrocarbyl group, such as alkyl, cycloalkyl, aryl, and aralkyl. While any such fuel-soluble tertiary monoamine can be used, the preferred materials are the (cycloalkyl)dialkylamines. Typically these preferred compounds have a cycloalkyl group containing from 5 to 10 carbon atoms and 2 alkyl groups each of which contains up to 10 carbon atoms. The most preferred substance for use as component g) is cyclohexyldimethylamine.

Component h). Suitable inert liquid solvents or diluents having final boiling points no higher than approximately 300° C. are available from a number of commercial sources. Such materials comprise liquid paraffinic, cycloparaffinic and aromatic hydrocarbons; alkanols (e.g., 2-ethylhexanol and isodecanol), ethers (e.g., methyl-tert-amyl ether), and esters (e.g., amyl acetate). Preferred are liquid aromatic hydrocarbons or blends thereof with up to 50% paraffinic hydrocarbons and/or cycloparaffinic hydrocarbons. Most preferred are aromatic hydrocarbons boiling in the range of 160° to 300° C. and having a viscosity in the range of 1.4 to 3.0 cSt at 25° C.

Proportions. The proportions of the additive components can be varied to suit the needs of any particular fuel and any particular set of service conditions for which the finished fuel is to be supplied. Nevertheless, for ease of reference, typical and preferred proportions of the components used in forming the compositions of this invention are set forth in the following tables. In these tables parts and percentages are by weight and are based on the active content of the additive component whereby the weight of diluent or solvent, if any, with which the component may be associated as received is excluded from the component weight. Table 1 sets forth the typical and preferred relative proportions of components a), b), c), d), e), f), g), and h) in both the additive concentrates and fuel compositions of this invention. These relative proportions are based on 100 parts by weight of component a). It will be recalled that components e), f), g), and h) are optional, but preferred, components. Component h) is a diluent or solvent and thus the amount thereof used in any given case is entirely optional as this merely governs how concentrated the additive concentrate will be. Normally the amount of component h) will not exceed 95% of the weight of the additive concentrate. As to the other optional, but preferred, components, one need only select the relative proportions for whichever, if any, of components e), f), and g) as are selected for inclusion in the composition. Table 2 gives the percentage ranges of components a), b), c), d), e), f), g), and h) in the typical and preferred additive concentrates of this invention that contain all such components. Table 3 gives the ranges of in parts per million (ppm) of components a), b), c), d), e), f), g), and h) in the typical and preferred fuel compositions of this invention that contain all such components.

TABLE 1

Relative Proportions in Concentrates and Fuels

| Component | Typical Compositions, parts by weight | Preferred Compositions, parts by weight |
|---|---|---|
| a) | 100 | 100 |
| b) | 60 to 900 | 130 to 375 |
| c) | 12 to 200 | 30 to 85 |
| d) | 18 to 140 | 40 to 120 |
| e) | 4 to 65 | 9 to 30 |
| f) | 20 to 155 | 40 to 130 |
| g) | 65 to 1000 | 140 to 450 |

TABLE 2

Make-up of Additive Concentrates

| Component | Typical Percentage | Preferred percentage |
|---|---|---|
| a) | 0.9 to 3.5 | 1.3 to 2.5 |
| b) | 1.5 to 9 | 3 to 6 |
| c) | 0.4 to 2 | 0.6 to 1.5 |
| d) | 0.5 to 3 | 0.9 to 2 |
| e) | 0.1 to 0.8 | 0.2 to 0.5 |
| f) | 0.5 to 3 | 0.8 to 2 |
| g) | 2.0 to 9.2 | 3.0 to 6 |
| h)* | Balance to 100% | Balance to 100% |

*Includes any additional additive components that may be included.

TABLE 3

Make-up of Fuel Compositions

| Component | Typical Amount, ppm | Preferred Amount, ppm |
|---|---|---|
| a) | 1.8 to 65 | 5.5 to 20 |
| b) | 4.0 to 165 | 12.0 to 40 |
| c) | 0.9 to 38 | 2.5 to 10 |
| d) | 1.2 to 26 | 3.5 to 12 |
| e) | 0.2 to 12 | 0.5 to 3.0 |
| f) | 1.3 to 28 | 4.0 to 15 |
| g) | 4.0 to 180 | 13.0 to 45 |
| h)* & Fuel | Balance to 1 million | Balance to 1 million |

*Includes any additional additive components that may be included.

The fuels of this invention will generally contain from 0.4 to 16.5 ppm of manganese as component a) together with the required additional components as well as any optional components selected for inclusion, and all of these additional components will typically be proportioned relative to component a) in the manner specified above.

The individual components a), b), c), d), and if used, e), f), g) and h) can be separately blended into the fuel or can be blended therein in various subcombinations, if desired. Moreover, one or more of such components can be blended in the form of a solution in a diluent, provided of course that the diluent does not materially detract from the performance of the finished composition. It is preferable, however, to blend the components used by employing an additive concentrate of this invention, as this simplifies the blending operations, reduces the likelihood of blending errors, and takes advantage of the compatibility and solubility characteristics afforded by the overall concentrate.

In addition to enabling evaporative burners to operate efficiently whereby the fuel composition evaporates cleanly, leaves little or no residues in the apparatus, burns cleanly and produces on combustion reduced amounts of smoke and noxious emissions, the compositions of this invention exhibit effective resistance to metallic corrosion. As an illustration of this corrosion resistance, the results of standard IP 135A and IP 135B rust tests are of particular interest.

In these tests the performance of a typical preferred fuel composition of this invention was compared to the same additive-free commercial evaporative burner fuel with and without additive formulations not of this invention. The fuel of this invention (Fuel A) contained 500 ppm of additive concentrate consisting of each of components a), b), c), d), e), f), g), and h). More particularly, the concentrate contained by weight on an active ingredient basis 1.9% of methylcyclopentadienyl manganese tricarbonyl, 4.1% of polyisobutenyl succinimide of tetraethylene pentamine (formed from polyisobutene of GPC number average molecular weight of substantially 950), 0.9% of dimer acid made from linoleic acid, 1.3% of N,N'-disalicylidene-1,2-propanediamine, 0.3% of ethoxylated nonylphenol (4 moles of ethylene oxide per mole of nonyl phenol), 1.4% of Armogard D5021 demulsfying agent, 4.5% of cyclohexyldimethylamine, with the balance being about 82% of a heavy aromatic naphtha having a flash point of 62° C., an initial boiling point of 185° C., a final boiling point of 240° C., and an aromatic content of 78% together with about 3.6% of diluent oil and solvents associated with some of the components as received.

For comparison, the same tests were performed on the additive-free base fuel (Fuel X), and the same base fuel containing the same additives as in Fuel A except that in both cases component (c) had been omitted. In addition, Fuel Y was devoid of component e), whereas Fuel Z was also devoid of component g). The test results are summarized in the Table 4 wherein the rating scale of A to E is used. An A rating means that no rusting or corrosion whatsoever existed on the test pieces at test end. Conversely, a rating of E means that very heavy rusting and corrosion occurred in the test. Intermediate ratings designate intermediate amounts of rusting and corrosion.

TABLE 4

| | Rust Test Results | | | |
|---|---|---|---|---|
| Test Used | Fuel A | Fuel X | Fuel Y | Fuel Z |
| IP 135A | A | B+ | B++ | B+ |
| IP 135B* | B, B+ | E, E | D, C | D, D |

*Results shown represent results of duplicate tests

As used herein the term "fuel-soluble" means that the component under discussion has sufficient solubility to dissolve at ambient room temperature in the base fuel selected for use to at least the minimum concentration level specified herein. Preferably, the component will have a substantially greater solubility than this under these same conditions. However, the term does not signify that the component must dissolve in all proportions in the base fuel.

Throughout this specification various patent documents have been referred to. Each one of these documents is incorporated herein by reference as if fully set forth herein.

I claim:

1. An additive composition adapted for use in hydrocarbonaceous distillate fuels for evaporative burners, said composition comprising a mixture formed from at least the following fuel-soluble components:

a) a cyclopentadienyl manganese tricarbonyl compound;

b) a succinic derivative ashless dispersant;

c) an aliphatic dicarboxylic acid having at least 24 carbon atoms in the molecule, the two carboxyl groups being separated from each other by at least 6 carbon atoms; and d) a metal deactivator of the chelation type: said composition being substantially devoid of any metal-containing additive component other than said cyclopentadienyl manganese tricarbonyl compound.

2. A composition in accordance with claim 1 wherein said composition further comprises one or more of the following additional fuel-soluble components blended therewith:

e) alkoxylated alkylphenol;

f) a demulsifying agent;

g) a tertiary monoamine in which each substituent on the nitrogen atom is a hydrocarbyl group;

h) liquid inert solvent having a final boiling point no higher than approximately 300° C.

3. A composition in accordance with claim 2 wherein said composition contains at least said component e) and wherein said component e) is an ethoxylated alkylphenol having 6 to 24 carbon atoms or an average in the range of 6 to 24 carbon atoms in the alkyl group.

4. A composition in accordance with claim 2 wherein said composition contains at least said component g) and wherein said component g) is a (cycloalkyl)dialkylamine.

5. A composition in accordance with claim 3 wherein said composition contains at least said component g) and wherein said component g) is a (cycloalkyl)dialkylamine.

6. A composition in accordance with claim 2 wherein said composition contains at least said component h) and wherein 50 wt % or more of said component h) is composed of aromatic hydrocarbons.

7. A composition in accordance with claim 3 wherein said composition contains at least said component h) and wherein 50 wt % or more of said component h) is composed of aromatic hydrocarbons.

8. A composition in accordance with claim 4 wherein said composition contains at least said component h) and wherein 50 wt % or more of said component h) is composed of aromatic hydrocarbons.

9. A composition in accordance with claim 2 wherein said composition further comprises at least said components e), g), and h).

10. A composition in accordance with claim 9 wherein said component e) is an ethoxylated alkylphenol having 6 to 24 carbon atoms or an average in the range of 6 to 24 carbon atoms in the alkyl group; wherein said component g) is a (cycloalkyl)dialkylamine; and wherein 50 wt % or more of said component h) is composed of aromatic hydrocarbons.

11. A composition in accordance with claim 2 wherein said composition further comprises all of said components e), f), g), and h).

12. A composition in accordance with claim 11 wherein said component e) is an ethoxylated alkylphenol having 6 to 24 carbon atoms or an average in the range of 6 to 24 carbon atoms in the alkyl group; wherein said component g) is a (cycloalkyl)dialkylamine; and wherein 50 wt % or more of said component h) is composed of aromatic hydrocarbons.

13. A composition in accordance with claim 1 wherein said cyclopentadienyl manganese tricarbonyl compound is a liquid under ambient room temperature conditions.

14. A composition in accordance with claim 13 wherein said liquid cyclopentadienyl manganese tricarbonyl compound is composed primarily or entirely of methylcyclopentadienyl manganese tricarbonyl.

15. A composition in accordance with claim 7 wherein said cyclopentadienyl manganese tricarbonyl compound is a liquid under ambient room temperature conditions.

16. A composition in accordance with claim 15 wherein said liquid cyclopentadienyl manganese tricarbonyl compound is composed primarily or entirely of methylcyclopentadienyl manganese tricarbonyl.

17. A composition in accordance with claim 12 wherein said cyclopentadienyl manganese tricarbonyl compound is a liquid under ambient room temperature conditions.

18. A composition in accordance with claim 17 wherein said liquid cyclopentadienyl manganese tricarbonyl compound is composed primarily or entirely of methylcyclopentadienyl manganese tricarbonyl.

19. A composition in accordance with claim 1 wherein said component b) is a alkyl- or alkenyl-substituted succinimide of a polyamine having an average in the range of 2 to 6 nitrogen atoms in the molecule, and wherein said alkyl or alkenyl substituent has an average in the range of 50 to 150 carbon atoms.

20. A composition in accordance with claim 2 wherein said component b) is a alkyl- or alkenyl-substituted succinimide of a polyamine having an average in the range of 2 to 6 nitrogen atoms in the molecule, and wherein said alkyl or alkenyl substituent has an average in the range of 50 to 150 carbon atoms.

21. A composition in accordance with claim 11 wherein said component b) is a alkyl- or alkenyl-substituted succinimide of a polyamine having an average in the range of 2 to 6 nitrogen atoms in the molecule, and wherein said alkyl or alkenyl substituent has an average in the range of 50 to 150 carbon atoms.

22. A composition in accordance with claim 18 wherein said component b) is a alkyl- or alkenyl-substituted succinimide of a polyamine having an average in the range of 2 to 6 nitrogen atoms in the molecule, and wherein said alkyl or alkenyl substituent has an average in the range of 50 to 150 carbon atoms.

23. A composition in accordance with claim 1 wherein said component d) is N,N'-disalicylidene-1,2-propanediamine.

24. A composition in accordance with claim 2 wherein components a), b), c), d), e) if present, f) if present, and g) if present are in relative proportions by weight on an active ingredient basis such for each 100 parts of a), there are from 60 to 900 parts of b), from 12 to 200 parts of c), from 18 to 140 parts of d), from 4 to 65 parts of e) if present, from 20 to 155 parts of f) if present, and from 65 to 1000 parts of g) if present.

25. A composition in accordance with claim 3 wherein components a), b), c), d), e), f) if present, and g) if present are in relative proportions by weight on an active ingredient basis such for each 100 parts of a), there are from 130 to 375 parts of b), from 30 to 85 parts of c), from 40 to 120 parts of d), from 9 to 30 parts of e), from 40 to 130 parts of f) if present, and from 140 to 450 parts of g) if present.

26. A composition in accordance with claim 22 wherein components a), b), c), d), e), f), and g) are in relative proportions by weight on an active ingredient basis such for each 100 parts of a), there are from 130 to 375 parts of b), from 30 to 85 parts of c), from 40 to 120 parts of d), from 9 to 30 parts of e), from 40 to 130 parts of f), and from 140 to 450 parts of g).

27. A fuel composition which comprises a hydrocarbonaceous fuel containing a combustion-improving amount of the additive components in accordance with claim 1.

28. A fuel composition which comprises a hydrocarbonaceous fuel containing a combustion-improving amount of the additive components in accordance with claim 2.

29. A fuel composition which comprises a hydrocarbonaceous fuel containing a combustion-improving amount of the additive components in accordance with claim 3.

30. A fuel composition which comprises a hydrocarbonaceous fuel containing a combustion-improving amount of the additive components in accordance with claim 7.

31. A fuel composition which comprises a hydrocarbonaceous fuel containing a combustion-improving amount of the additive components in accordance with claim 11.

32. A fuel composition which comprises a hydrocarbonaceous fuel containing a combustion-improving amount of the additive components in accordance with claim 26.

33. The method of improving combustion and fuel performance in the operation of an evaporative burner which comprises supplying as fuel for said burner a hydrocarbonaceous distillate fuel composition in accordance with claim 28.

34. The method of improving combustion and fuel performance in the operation of an evaporative burner which comprises supplying as fuel for said burner a hydrocarbonaceous distillate fuel composition in accordance with claim 31.

35. The method of improving combustion and fuel performance in the operation of an evaporative burner which comprises supplying as fuel for said burner a hydrocarbonaceous distillate fuel composition in accordance with claim 32.

* * * * *

UNITED STATES PATENT AND TRADEMARK OFFICE

CERTIFICATE OF CORRECTION

PATENT NO. : 5,525,127

DATED : June 11, 1996

INVENTOR(S) : Gareth C. Jeffrey

It is certified that error appears in the above-indentified patent and that said Letters Patent is hereby corrected as shown below:

On the Title page, please add --Item [30] References Cited:

December 23, 1993 (GB) United Kingdom....9326263.2--.

Signed and Sealed this

Third Day of September, 1996

*Attest:*

*Attesting Officer*

BRUCE LEHMAN

*Commissioner of Patents and Trademarks*